US010487617B2

(12) United States Patent
Chen

(10) Patent No.: US 10,487,617 B2
(45) Date of Patent: Nov. 26, 2019

(54) CENTRAL SHAFT FOR BRIDGE PLUG, BRIDGE PLUG AND SETTING METHOD FOR THE SAME

(71) Applicant: Aimin Chen, Beijing (CN)

(72) Inventor: Aimin Chen, Beijing (CN)

( * ) Notice: Subject to any disclaimer, the term of this patent is extended or adjusted under 35 U.S.C. 154(b) by 184 days.

(21) Appl. No.: 15/718,591

(22) Filed: Sep. 28, 2017

(65) Prior Publication Data

US 2018/0305997 A1 Oct. 25, 2018

(30) Foreign Application Priority Data

Apr. 20, 2017 (CN) ..... 2017 1 0291575
Apr. 20, 2017 (CN) ..... 2017 2 0473739 U

(51) Int. Cl.

| | |
|---|---|
| ***E21B 23/06*** | (2006.01) |
| ***E21B 29/00*** | (2006.01) |
| ***E21B 33/12*** | (2006.01) |
| ***E21B 33/128*** | (2006.01) |
| ***E21B 33/129*** | (2006.01) |
| ***E21B 33/134*** | (2006.01) |

(52) U.S. Cl.

CPC ..... *E21B 33/1292* (2013.01); *E21B 23/06* (2013.01); *E21B 29/00* (2013.01); *E21B 33/128* (2013.01); *E21B 33/1208* (2013.01); *E21B 33/134* (2013.01)

(58) Field of Classification Search

CPC ..... E21B 23/06; E21B 29/00; E21B 33/1208; E21B 33/128; E21B 33/1292; E21B 33/134

See application file for complete search history.

(56) References Cited

U.S. PATENT DOCUMENTS

| | | | | |
|---|---|---|---|---|
| 4,149,594 A * | 4/1979 | Evans | E21B 33/1294 | 166/133 |
| 4,436,150 A * | 3/1984 | Barker | E21B 33/134 | 166/123 |
| 4,646,829 A * | 3/1987 | Barrington | E21B 23/006 | 166/125 |
| 2004/0216868 A1* | 11/2004 | Owen, Sr. | E21B 23/06 | 166/134 |
| 2010/0132960 A1* | 6/2010 | Shkurti | E21B 33/134 | 166/387 |
| 2011/0048740 A1* | 3/2011 | Ward | E21B 33/134 | 166/381 |
| 2014/0196913 A1* | 7/2014 | Pedersen | E21B 33/1293 | 166/386 |
| 2016/0032682 A1* | 2/2016 | Sommers | E21B 33/1293 | 166/135 |
| 2016/0138363 A1* | 5/2016 | Sommers | E21B 23/06 | 166/387 |

* cited by examiner

*Primary Examiner* — Daniel P Stephenson
(74) *Attorney, Agent, or Firm* — IPro, PLLC

(57) ABSTRACT

A central shaft for a bridge plug, the bridge plug and a setting method for the bridge plug are disclosed. The central shaft comprises a setting mandrel and a setting tubular shaft, and the setting tubular shaft includes a squeezing shoulder for squeezing a compression ring or a reducing support ring of the bridge plug, and a support trunk. After the setting mandrel is disconnected from a downstream-end support, the setting mandrel can be withdrawn from the central hole of the setting tubular shaft so that the central hole of the setting tubular shaft forms an internal fluid channel of the bridge plug.

32 Claims, 14 Drawing Sheets

CENTRAL SHAFT FOR BRIDGE PLUG, BRIDGE PLUG AND SETTING METHOD FOR THE SAME

FIELD OF THE INVENTION

The present disclosure relates to the technical field of bridge plug, and in particular to a central shaft for a bridge plug, a bridge plug using the central shaft and a setting method for the bridge plug.

BACKGROUND OF THE INVENTION

In the exploration and development of an oilfield, a temporary plugging process is needed to plug a current production zone to facilitate implementation of process measures to other production zones. The temporary plugging is cancelled after the completion of the process, and a flowing channel between the production zone (or zones) and the shaft is established for oil extraction and gas production on oil and gas wells. Although the plugging technology using bridge plugs has been widely applied in the fracturing measure innovation and the processes of development and production, the inventors of the present application have found that at least the following technical problems exist in a bridge plug as shown in FIG. 1 provided by the prior art.

Firstly, the normal use of the bridge plug is affected by the issue of midway setting, which easily occurs in the process of running the bridge plug due to free movement of a bridge plug running tool and release setting of the bridge plug. Once the midway setting occurs, recovery or drilling removal treatment needs to be carried out, which influences the period and costs of construction.

Secondly, recovery or plug drilling is high in cost and difficulty, restrictive conditions (e.g., settled sand, dropping objects, and well wall scale) in a shaft during plug drilling lead to more difficult plug drilling, and the shaft thus needs to be treated in advance through other processes, which leads to the increase in costs of construction, and even complex conditions occurred in the shaft, affecting the normal production of oil and gas wells.

Thirdly, the existing bridge plug is unstable in plugging effect after setting. The reason for this is that a leaking channel exists between a rubber cylinder of the bridge plug and a well wall, and the bridge plug loses the role of plugging, resulting in unclear directions where a fracturing fluid goes and causing serious waste.

Fourthly, the bridge plug is unreliable in anchoring after setting, and goes down during fracturing, leading to the cancellation of zoning and a serious impact on the quality of zonal fracturing construction.

Fifthly, it has been conceived that degradable materials are used to manufacture the bridge plug. However, the degradation characteristics of degradable plastics and degradable metal materials are restricted by the environment of their applications, and the strength of the degradable materials is 50% lower than that of carbon steel metal materials, so that this kind of materials cannot be used to manufacture a bridge plug with a large inner diameter.

SUMMARY OF THE INVENTION

The present disclosure discloses a central shaft for a bridge plug, a bridge plug and a setting method for the bridge plug. The present disclosure addresses the technical problems existing in the prior art that degradable plastics and degradable metal materials are unable to manufacture a bridge plug with a large inner diameter.

An objective of the present disclosure is to provide a central shaft for a bridge plug, the bridge plug using the central shaft and a setting method for the bridge plug, which are capable of addressing at least one of the above technical problems.

According to a first aspect of the present disclosure, a central shaft for a bridge plug is provided, comprising a setting mandrel and a setting tubular shaft, wherein, the setting tubular shaft is provided with a central hole, and includes a squeezing shoulder for squeezing a compression ring or an upper slip assembly of the bridge plug, and a support trunk for at least supporting the upper slip assembly, a reducing support ring, a slip platen and an elastic sealing cylinder of the bridge plug;

the central hole of the setting tubular shaft is sleeved outside the setting mandrel, and the setting tubular shaft is axially slidable relative to the setting mandrel to a setting position where the setting tubular shaft enables the squeezing shoulder to squeeze the compression ring or the upper slip assembly of the bridge plug into a setting state;

an upstream end of the setting mandrel is adapted to be connected to a bridge plug running tool, and a downstream end of the setting mandrel is connected to a downstream-end support of the bridge plug in such a manner that in the case where the setting tubular shaft is in the setting state, the setting mandrel can be disconnected from the downstream-end support by means of relative movement; and after disconnection of the setting mandrel from the downstream-end support, the setting mandrel can be withdrawn from the central hole of the setting tubular shaft so that the central hole of the setting tubular shaft forms an internal fluid channel of the bridge plug; and the strength of the material of the setting mandrel is higher than the strength of a degradable material or corrodible material; and the material of the setting tubular shaft is a degradable material or a corrodible material, or a material having the strength not lower than the strength of the degradable material or corrodible material.

According to a second aspect of the present disclosure, a bridge plug is provided, comprising an elastic sealing cylinder, a slip platen, a reducing support ring, a compression ring, an upper slip assembly, a lower slip assembly, a downstream-end support, and the central shaft for the bridge plug according to the first aspect of the present disclosure, wherein each of the elastic sealing cylinder, the slip platen, the reducing support ring, the compression ring, the upper slip assembly and the lower slip assembly is sleeved on the support trunk of the sealing tubular shaft; the squeezing shoulder of the setting tubular shaft is abutted against the compression ring; and when an outer cylinder of the bridge plug running tool pushes the squeezing shoulder in a direction towards the bottom of an oil-gas well where the bridge plug is located, the setting tubular shaft slides relative to the setting mandrel to a setting position;

in the case where the setting tubular shaft is in the setting state, the bridge plug running tool can bring the setting mandrel into movement relative to the downstream-end support so as to disconnect the setting mandrel from the downstream-end support;

the compression ring and the downstream-end support are abutted against the upper slip assembly and the lower slip assembly, the upper slip assembly and the lower slip assembly are abutted against the slip platen, and the reducing support ring is arranged between the slip platen and the elastic sealing cylinder; and the reducing support ring can be set onto the inner wall of a sleeve where the bridge plug is located, under the action of an axial squeezing force exerted by the slip platen and the elastic sealing cylinder jointly.

According to a third aspect of the present disclosure, a setting method for the bridge plug according to the second aspect of the present disclosure is provided, comprising the steps of:

a setting mandrel of the bridge plug being pulled by a bridge plug running tool such that a squeezing shoulder of a setting tubular shaft is abutted against a compression ring of the bridge plug;

the squeezing shoulder being pushed by an outer cylinder of the bridge plug running tool in a direction towards the bottom of an oil-gas well where the bridge plug is located, so that the setting tubular shaft slides to a setting position relative to the setting mandrel; and the setting tubular shaft being in the setting position enabling the squeezing shoulder to squeeze the compression ring of the bridge plug into a setting state so that the compression ring and the downstream-end support are abutted against the upper slip assembly and the lower slip assembly, the upper slip assembly and the lower slip assembly are abutted against the slip platen, and the reducing support ring is set onto the inner wall of a sleeve where the bridge plug is located, under the action of an axial squeezing force exerted by the slip platen and the elastic sealing cylinder jointly; in the case where the setting tubular shaft is in the setting state, the bridge plug running tool bringing the setting mandrel into movement relative to the downstream-end support so as to disconnect the setting mandrel from the downstream-end support; and after disconnection of the setting mandrel from the downstream-end support, the setting mandrel being withdrawn from a central hole of the setting tubular shaft by the bridge plug running tool so that the central hole of the setting tubular shaft forms an internal fluid channel of the bridge plug.

In the central shaft for the bridge plug provided by the present disclosure, the setting mandrel not only functions as a release sub as in the existing bridge plug, but can also function in a manner so that, after the bridge plug is set on the inner wall of a sleeve (or the wall of a well if necessary) and the setting tubular shaft is in the setting state, the setting mandrel can be brought (by a bridge plug running tool) to move and thus be disconnected from the downstream-end support of the bridge plug. After the setting mandrel is withdrawn from the central hole of the setting tubular shaft, the downstream-end support of the bridge plug drops to the bottom of the well and the central hole of the setting tubular shaft forms an internal fluid channel of the bridge plug. Since the strength of the material of the setting mandrel is higher than the strength of the degradable material or corrodible material and the strength of the material of the setting tubular shaft is not lower than the strength of the degradable material or corrodible material, the presence of the setting mandrel (and even the setting tubular shaft) increases the overall strength of the central shaft of the bridge plug. Under the premise that the overall strength of the central shaft of the bridge plug can meet the requirements for setting of the bridge plug, the wall thickness of the setting tubular shaft can be made very thin, and accordingly the dimension of the central hole of the setting tubular shaft, i.e. the inner diameter of the internal fluid channel of the bridge plug, can be made larger than the existing bridge plug.

DETAILED DESCRIPTION OF THE EMBODIMENTS

Figure 1:
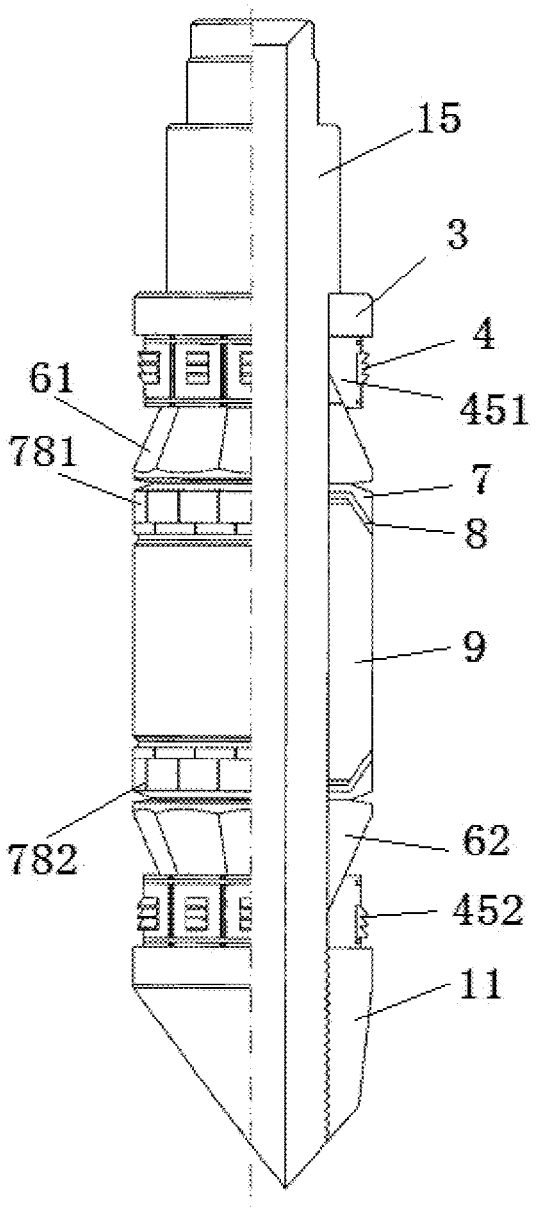
FIG. 1 is a schematic diagram of a bridge plug provided in the prior art.
Figure 2:
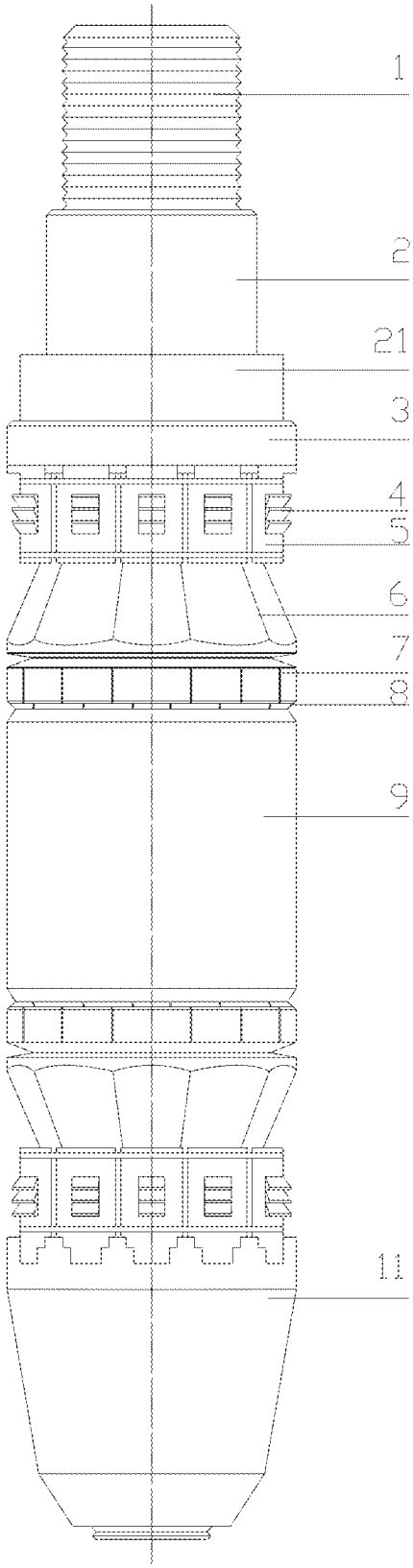
FIG. 2 is a schematic diagram of a bridge plug provided by an embodiment of the present disclosure.
Figure 3:
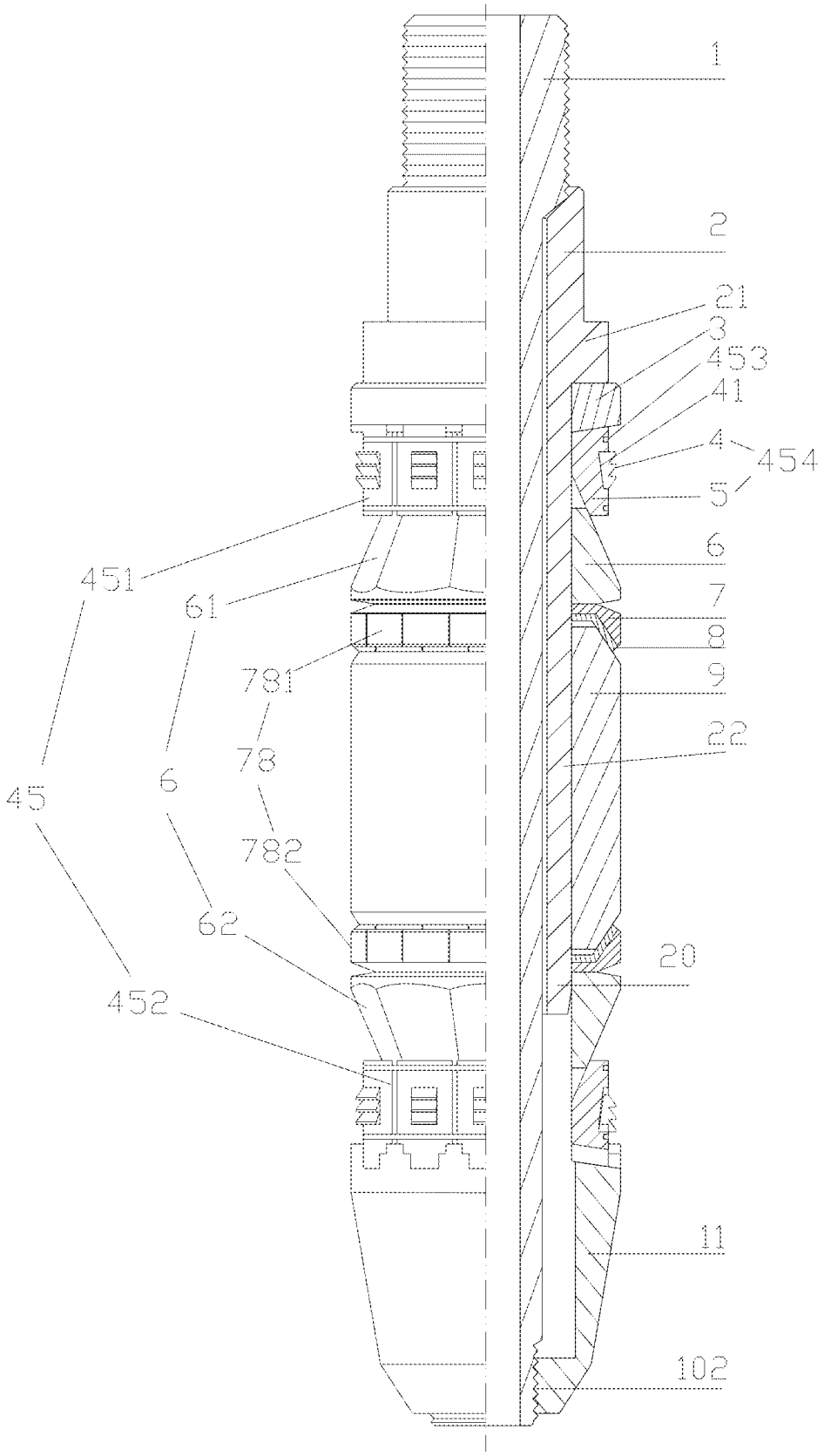
FIG. 3 is a partial sectional schematic diagram of a bridge plug provided by an embodiment of the present disclosure.
Figure 4:
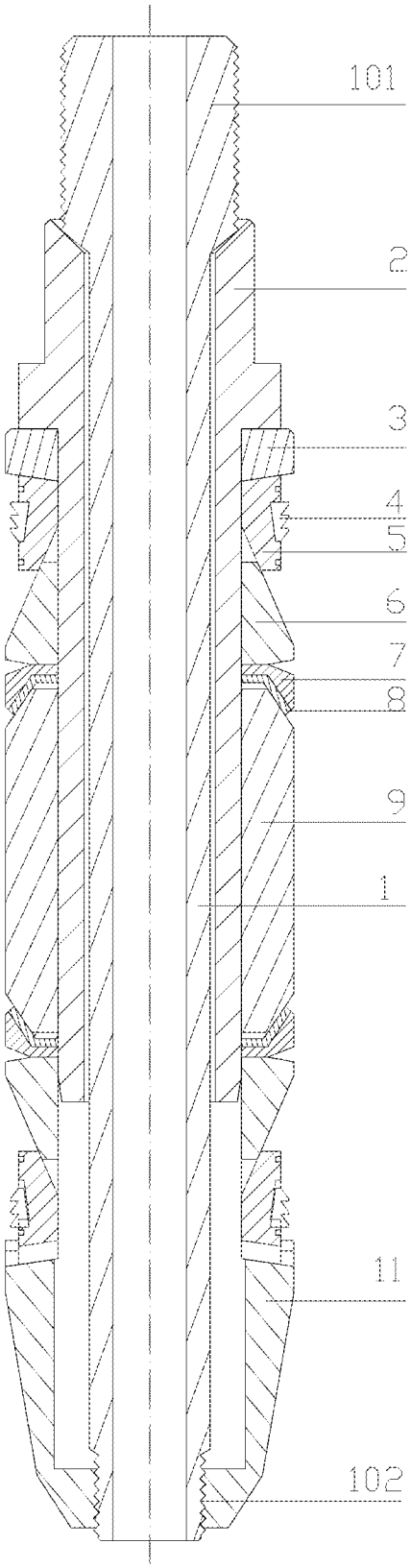
FIG. 4 is a sectional schematic diagram of a bridge plug provided by an embodiment of the present disclosure.
Figure 5:
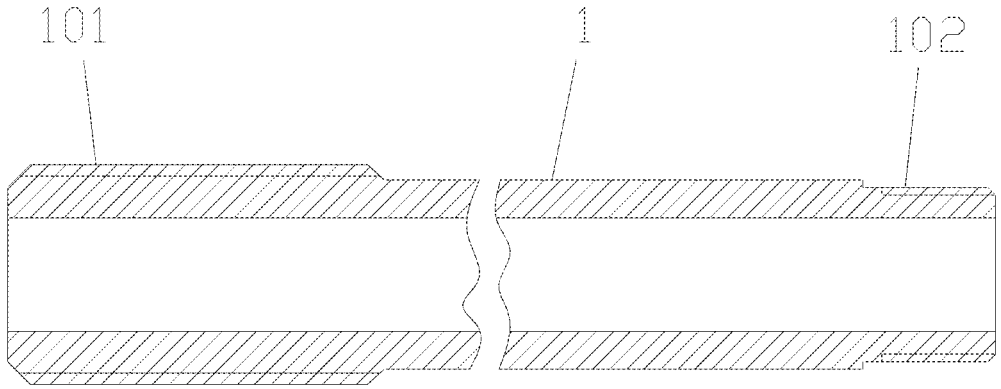
FIG. 5 is a sectional schematic diagram of a setting mandrel of a bridge plug provided by an embodiment of the present disclosure.
Figure 6:
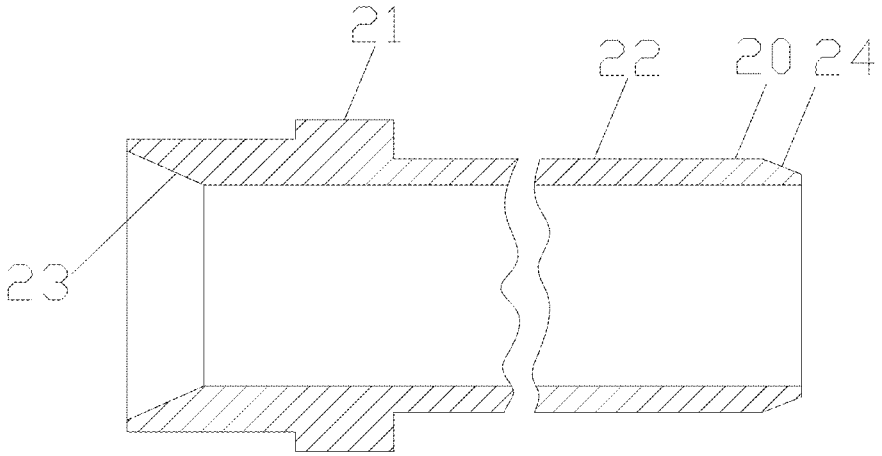
FIG. 6 is a sectional schematic diagram of a setting tubular shaft of a bridge plug provided by an embodiment of the present disclosure.
Figure 7:
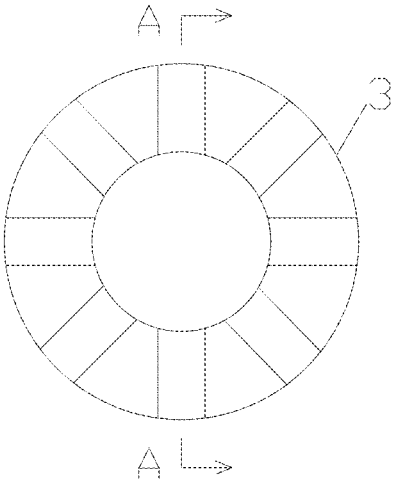
FIG. 7 is a schematic diagram of a compression ring of a bridge plug provided by an embodiment of the present disclosure.
Figure 8:
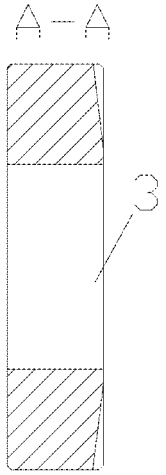
FIG. 8 is a sectional schematic diagram of FIG. 7 taken along A-A line.
Figure 9:
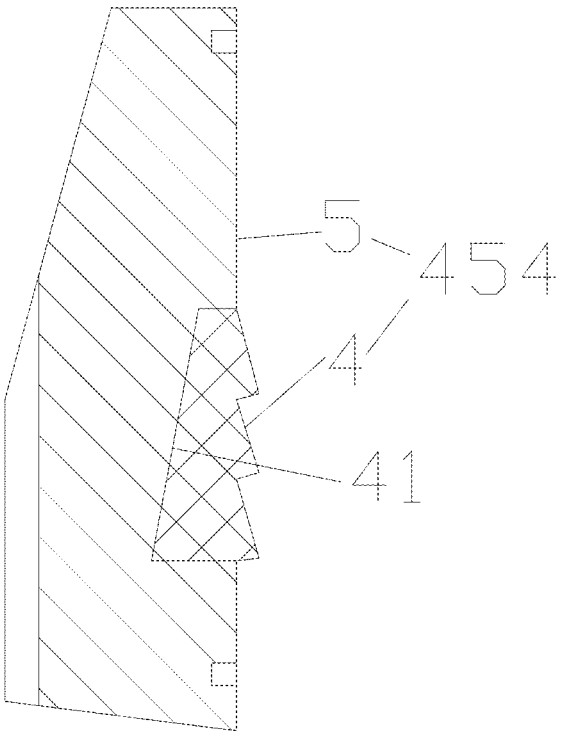
FIG. 9 is a sectional schematic diagram of a slip of a bridge plug provided by an embodiment of the present disclosure.
Figure 10:
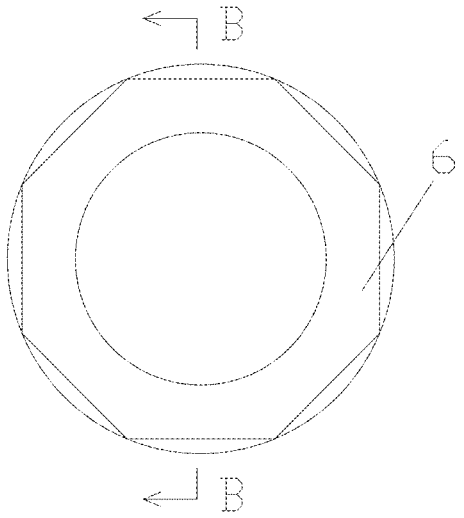
FIG. 10 is a schematic diagram of a slip platen of a bridge plug provided by an embodiment of the present disclosure.
Figure 11:
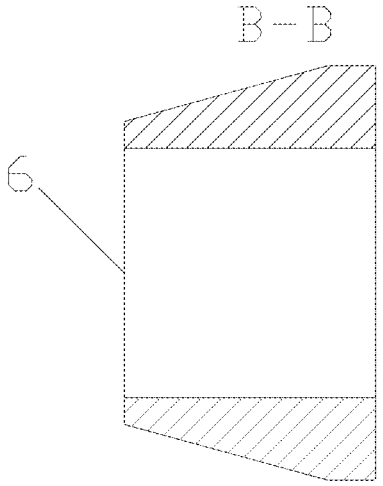
FIG. 11 is a sectional diagram of FIG. 10 taken along B-B line.
Figure 12:
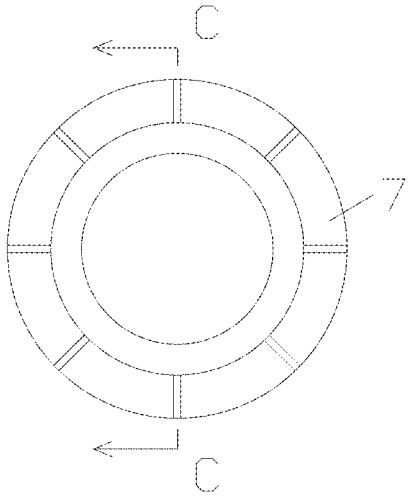
FIG. 12 is a schematic diagram of a first ring-shaped body of a reducing support ring in a bridge plug provided by an embodiment of the present disclosure.
Figure 13:
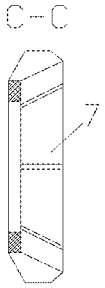
FIG. 13 is a sectional diagram of FIG. 12 taken along C-C line.
Figure 14:
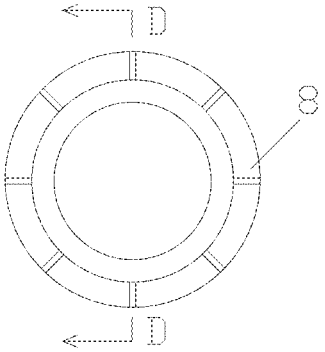
FIG. 14 is a schematic diagram of a second ring-shaped body of a reducing support ring in a bridge plug provided by an embodiment of the present disclosure.
Figure 15:
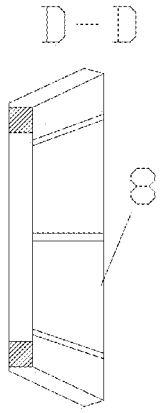
FIG. 15 is a sectional diagram of FIG. 14 taken along D-D line.
Figure 16:
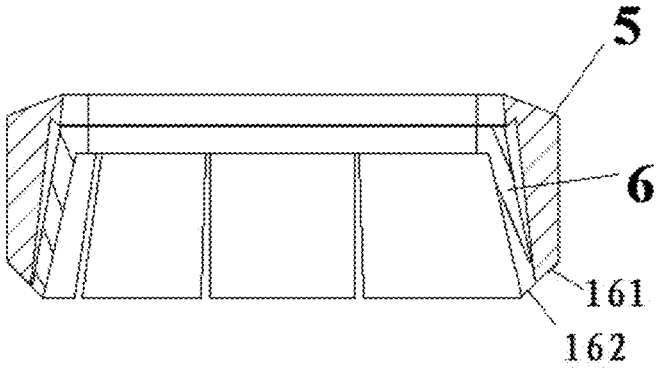
FIG. 16 is a sectional schematic diagram of a reducing support ring in a bridge plug provided by an embodiment of the present disclosure.
Figure 17:
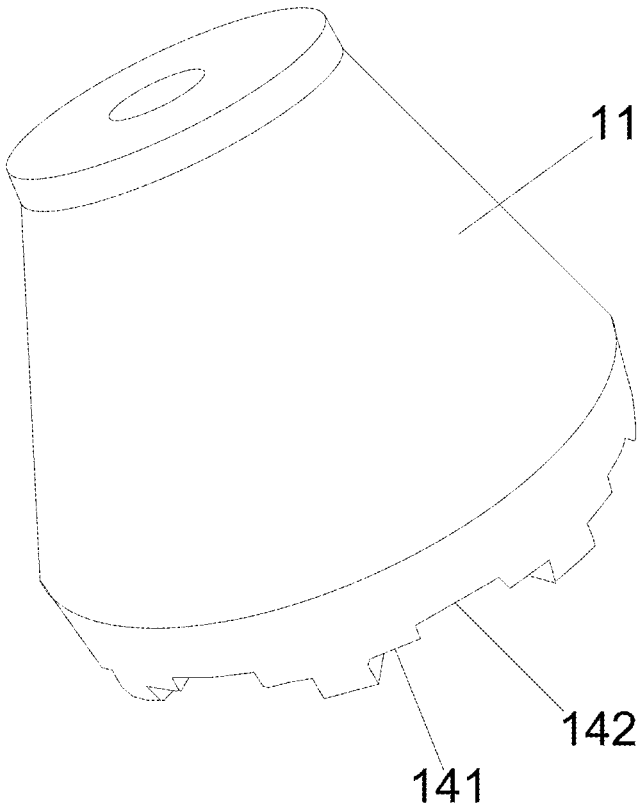
FIG. 17 is a perspective schematic diagram of a downstream-end support structure in a bridge plug provided by an embodiment of the present disclosure.
Figure 18:
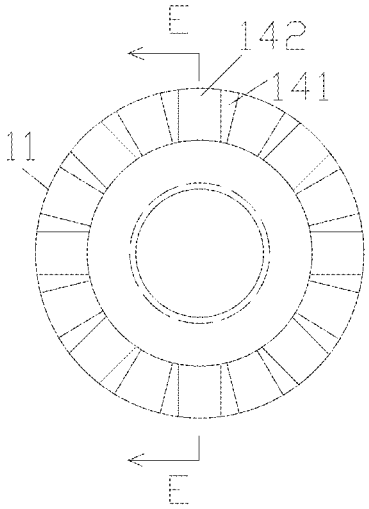
FIG. 18 is a schematic diagram of a downstream-end support structure in a bridge plug provided by an embodiment of the present disclosure.
Figure 19:
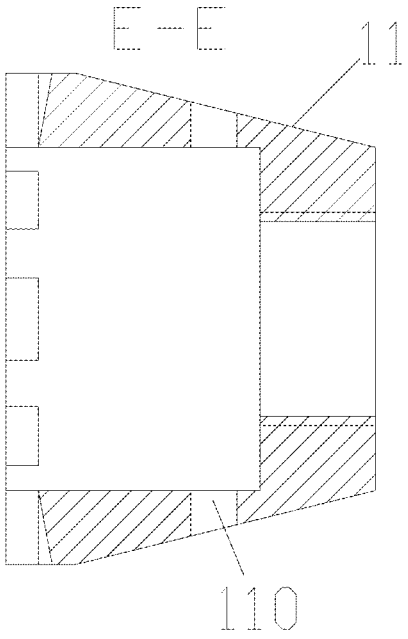
FIG. 19 is a sectional schematic diagram of FIG. 18 taken along E-E line.
Figure 20:
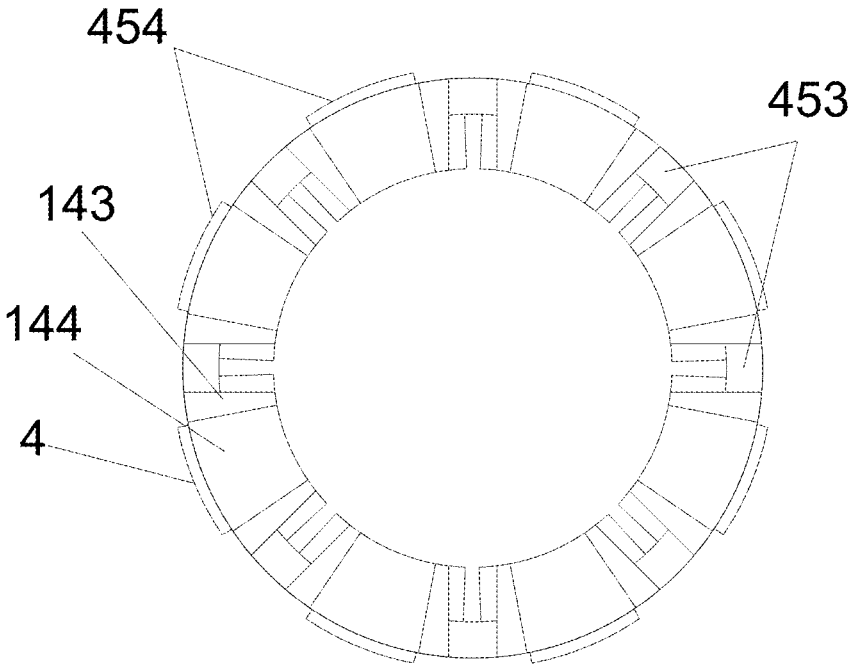
FIG. 20 is a schematic diagram of a slip assembly of a bridge plug provided by an embodiment of the present disclosure.
Figure 21:
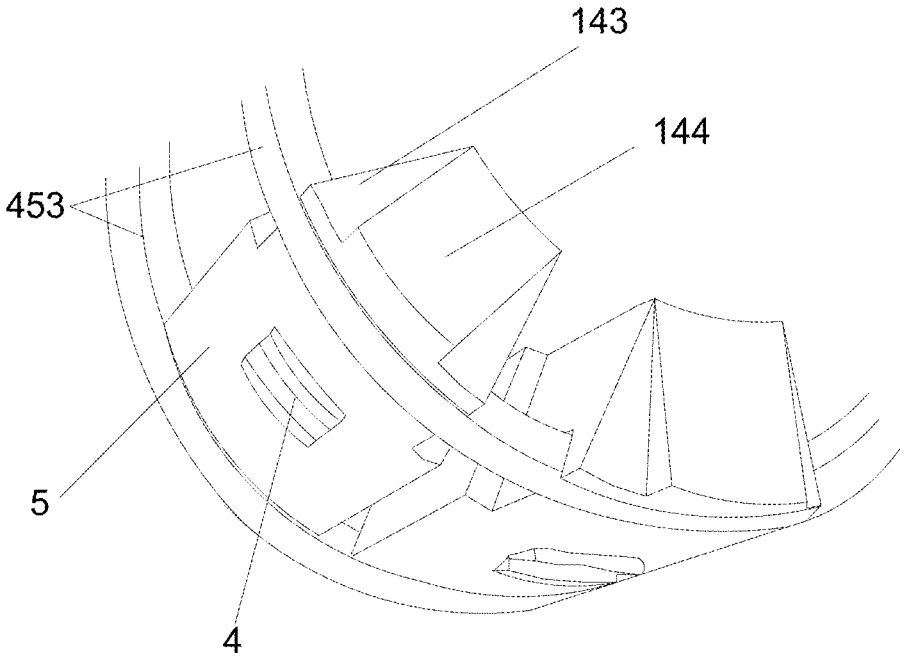
FIG. 21 is a perspective schematic diagram of a partial structure of a slip assembly in a bridge plug provided by an embodiment of the present disclosure.
Figure 22:
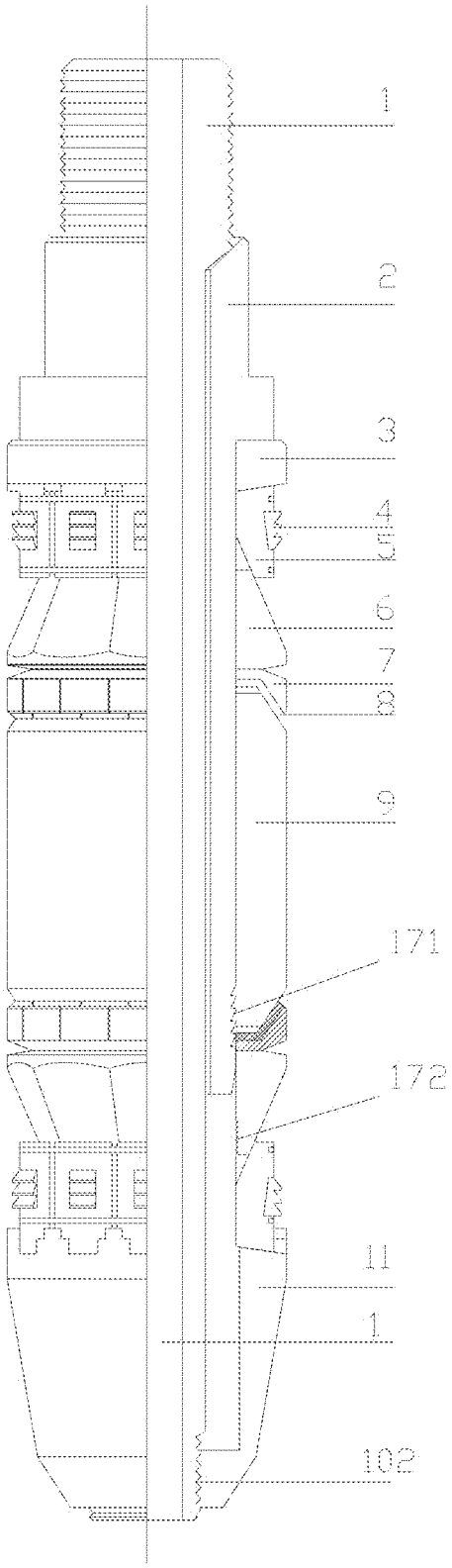
FIG. 22 is a partial sectional schematic diagram of a bridge plug provided by an embodiment of the present disclosure.
Figure 23:
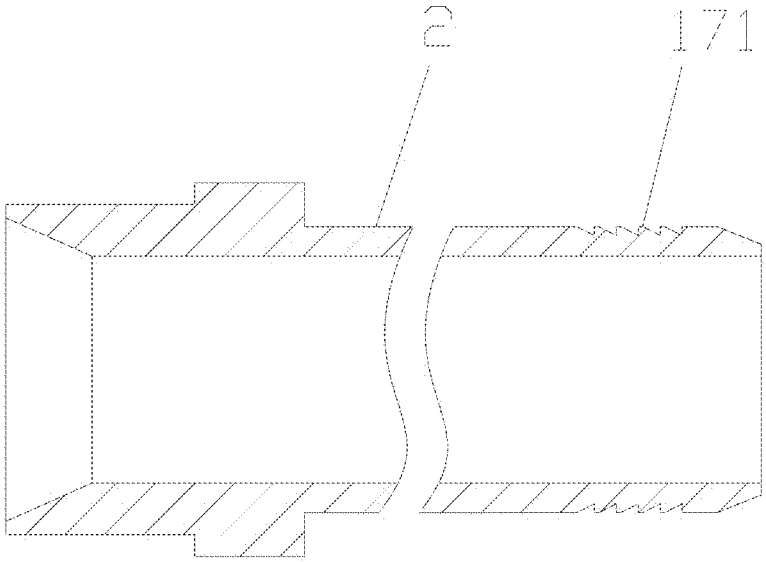
FIG. 23 is a sectional schematic diagram of a setting tubular shaft of a bridge plug as shown in FIG. 22.
Figure 24:
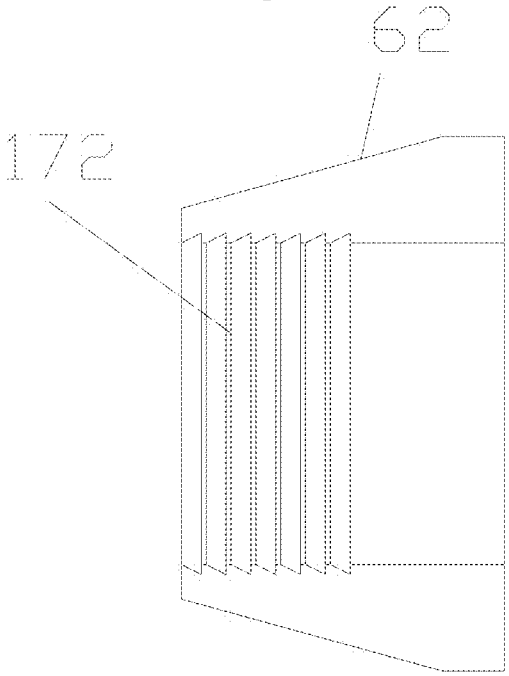
FIG. 24 is a sectional schematic diagram of a lower slip platen of a bridge plug as shown in FIG. 22.

As shown in FIGS. 2-24, a central shaft for a bridge plug provided by an embodiment of the present disclosure comprises a setting mandrel 1 and a setting tubular shaft 2, wherein the setting tubular shaft 2 is provided with a central hole, and includes a squeezing shoulder 21 for squeezing a compression ring (which may also be referred as a pushing disc, a positioning disc, a squeezing ring) 3 of the bridge plug or an upper slip assembly 451 of the bridge plug, and a support trunk 22 for at least supporting the upper slip assembly 451, a reducing support ring (which may also be referred as a reducing sheath) 78, a slip platen (preferably a hollow cone) 6 and an elastic sealing cylinder (preferably a degrading rubber cylinder) 9 of the bridge plug, wherein the elastic sealing cylinder 9 may be formed by splicing a plurality of segments of elastic rings or elastic cylinders;

the central hole of the setting tubular shaft 2 is sleeved outside the setting mandrel 1 and the setting tubular shaft 2 is axially slidable relative to the setting mandrel 1 to a setting position where the setting tubular shaft 2 enables the squeezing shoulder 21 to squeeze the compression ring 3 of the bridge plug or the upper slip assembly 451 of the bridge plug to a setting state;

an upstream end of the setting mandrel 1 is adapted to be connected to a bridge plug running tool, and a downstream end 102 of the setting mandrel 1 is connected to a downstream-end support (which may also be referred as a positioning push sheath) of the bridge plug in such a manner that in the case where the setting tubular shaft is in the setting state, the setting mandrel 1 can be disconnected from the downstream-end support 11 by relative movement (e.g. relative rotation or relative translation); and after disconnection of the setting mandrel 1 from the downstream-end support 11, the setting mandrel 1 can be withdrawn from the central hole of the setting tubular shaft 2 so that the central hole of the setting tubular shaft 2 forms an internal fluid channel of the bridge plug; and the strength of the material of the setting mandrel 1 is higher than the strength of a degradable material or corrodible material, and the material of the setting tubular shaft 2 is preferably a degradable material or corrodible material.

Of course, the material of the setting tubular shaft 2 may also be a material having the strength not lower than the strength of the degradable material or corrodible material.

In the central shaft for the bridge plug provided by the present disclosure, the setting mandrel 1 not only functions as a release sub as in the existing bridge plug, but can also function in a manner so that, after the bridge plug is set on the inner wall of a sleeve (or the wall of a well if necessary) and the setting tubular shaft 2 is in the setting state, the setting mandrel 1 can be brought (by a bridge plug running tool) to move and thus be disconnected from the downstream-end support 11 of the bridge plug. After the setting mandrel 1 is withdrawn from the central hole of the setting tubular shaft 2, the downstream-end support 11 of the bridge plug drops to the bottom of the well and the central hole of the setting tubular shaft 2 forms an internal fluid channel of the bridge plug. Since the strength of the material of the setting mandrel 1 is higher than the strength of the degradable material or corrodible material and the strength of the material of the setting tubular shaft 2 is not lower than the strength of the degradable material or corrodible material, the presence of the setting mandrel 1 (and even the setting tubular shaft 2) increases the overall strength of the central shaft of the bridge plug. Under the premise that the overall strength of the central shaft of the bridge plug can meet the requirements for setting of the bridge plug, the wall thickness of the setting tubular shaft 2 can be made very thin, and accordingly the dimension of the central hole of the setting tubular shaft 2, i.e. the inner diameter of the internal fluid channel of the bridge plug, can be made larger than the existing bridge plug.

Alternatively, the strength of the material of the setting mandrel 1 is 1.5~5 times the strength of the material of the setting tubular shaft 2. The higher the strength of the material of the setting mandrel 1 is, the thinner the wall thickness of the setting tubular shaft 2 made of degradable material or corrodible material can be made while the overall strength of the central shaft of the bridge plug meets the requirements for setting, ensuring that the dimension of the central hole of the setting tubular shaft 2, i.e. the inner diameter of the internal fluid channel of the bridge plug, can be made as large as possible compared with the existing bridge plug. However, if the strength of the material of the setting mandrel 1 is excessively high, there will be stricter requirements for the material and accordingly the costs of the setting mandrel 1 will be increased. The material of the setting mandrel 1 can be steel, which not only is cost effective, but has also the strength higher than the strength of the material of the setting tubular shaft 2, and thus it is suitable for manufacturing the setting mandrel 1.

All the members except for the setting mandrel 1 of the bridge plug are preferably made of degradable materials or corrodible materials. This is advantageous in that: bridge plug members of degradable material or corrodible material can be degraded naturally or corroded rapidly after completion of the formation fracturing operation, so that the plug drilling process can be omitted. In addition, in case of failure in setting, the bridge plug members of degradable material or corrodible material may be degraded or corroded naturally before the setting of a new bridge plug. Therefore, the issue of midway setting may be avoided, and accordingly the construction is convenient.

Alternatively, the downstream end 102 of the setting mandrel 1 extends beyond the central hole of the setting tubular shaft 2 in the dropping direction of the bridge plug, and in the axial direction of the setting tubular shaft 2, the position where the downstream end 102 of the setting mandrel 1 is connected with the downstream-end support 11 of the bridge plug is spaced by a gap from an end surface of the downstream end 20 of the setting tubular shaft 2. In this instance, the setting tubular shaft 2 is a half-shaft structure, and can thus be a half-shaft for setting. The setting tubular shaft 2 in half-shaft structure not only has high-speed natural degradation or corrosion, but involves less material consumption, a lower cost, a light weight and convenience for assembling.

Alternatively, the axial dimension of the setting tubular shaft 2 is ⅓~⅘ of the axial dimension of the setting mandrel 1. If the setting tubular shaft 2 is excessively long, the speed of natural degradation or corrosion will be low and the material consumption will be more. On the contrary, if the setting tubular shaft 2 is excessively short, the effect of supporting the reducing support ring 78, the slip platen 6 and the elastic sealing cylinder 9 of the bridge plug will be unsatisfactory. The practice shows that the setting tubular shaft 2 having an axial dimension within the above range can degrade or corrode at a high speed and can desirably support the reducing support ring 78, the slip platen 6 and the elastic sealing cylinder 9 of the bridge plug.

Alternatively, the downstream end 102 of the setting mandrel 1 is connected with the downstream-end support 11 of the bridge plug by threads or pins. The threaded connection has the advantages of compact structure and convenient removal, as well as the disconnection at a higher speed.

Alternatively, an upstream end of the setting mandrel 1 extends beyond the central hole of the setting tubular shaft 2 in a direction towards an opening of an oil-gas well where the bridge plug is located, and the upstream end of the setting mandrel 1 is connected with the bridge plug running tool by threads. The threaded connection herein not only has the advantages of compact structure and convenient removal, but can also cause the connecting force between the upstream end of the setting mandrel 1 and the bridge plug running tool to be adjusted by the length of the section of the threaded connection therebetween.

Alternatively, the upstream end of the setting tubular shaft 2 is provided at its port with an inner conical surface 23, of which the inner diameter is gradually reduced along the dropping direction of the bridge plug, and the upstream end of the setting mandrel 1 is provided with an outer conical surface having a shape conforming to the shape of the inner conical surface 23 so as to facilitate the insertion and withdrawal of the setting mandrel 1.

Alternatively, the setting mandrel 1 is provided with an axial central through-hole through the setting mandrel 1 along the overall axial direction of the setting mandrel 1. The axis of the axial central through-hole may overlap or be parallel with the axis of the central hole of the setting tubular shaft 2. The axial central through-hole not only forms an internal fluid channel of the bridge plug before the implementation of the setting operation of the central shaft for the bridge plug, but can also reduce the weight of the setting mandrel 1.

Alternatively, the setting tubular shaft 2 may be an integral structure. The setting mandrel 1 may be formed by fixed connection of different structural members, or may be formed by cutting a steel tube or a steel column of the integral structure. The integral structure means a structural member that is extrusion-formed by casting, forging or punching, and such a structural member has the advantage of uniform connecting strength among individual parts. The setting mandrel 1 formed by fixed connection of different structural members has the advantages of high production efficiency, low costs and high material availability.

Alternatively, an outer relief conical surface 24 is provided at an outer wall edge of the downstream end 20 of the setting tubular shaft 2. On one hand, the outer relief conical surface 24 can avoid stress concentration at the outer wall edge of the downstream end 20 of the setting tubular shaft 2. On the other hand, it can facilitate the reducing support ring 78, the slip platen 6 and the elastic sealing cylinder 9, etc., to be sleeved on the support trunk 22 of the setting tubular shaft 2.

A bridge plug provided in an embodiment of the present disclosure comprises an elastic sealing cylinder 9, a slip platen 6, a reducing support ring 78, a compression ring 3, slip assemblies 45 (comprising an upper slip assembly 451 and a lower slip assembly 452), a downstream-end support 11 and a central shaft for a bridge plug as provided in any one technical solution of the present disclosure, wherein each of the elastic sealing cylinder 9, the slip platen 6, the reducing support ring 78, the compression ring 3 and the slip assemblies 45 is sleeved on the support trunk 22 of the setting tubular shaft 2;

a squeezing shoulder 21 of a setting tubular shaft 2 is abutted against the compression ring 3, and when an outer cylinder of a bridge plug running tool pushes the squeezing shoulder 21 in a direction towards the bottom of an oil-gas well where the bridge plug is located, the setting tubular shaft 2 slides relative to the setting mandrel 1 to a setting position; in the case where the setting tubular shaft 2 is in a setting state (the squeezing shoulder 21 may squeeze the compression ring 3 or the reducing support ring 78 to a setting state), the bridge plug running tool may bring the setting mandrel 1 into movement relative to the downstream-end support 11 so as to disconnect the setting mandrel 1 from the downstream-end support 11;

the compression ring 3 and the downstream-end support 11 are abutted against the upper slip assembly 451 and the lower slip assembly 452, the upper slip assembly 451 and the lower slip assembly 452 are abutted against the slip platen 6, and the reducing support ring 78 is disposed between the slip platen 6 and the elastic sealing cylinder 9;

the reducing support ring 78 can be set on an inner wall of a sleeve where the bridge plug is located under the action of an axial squeezing force exerted by the slip platen 6 and the elastic sealing cylinder 9 jointly.

The bridge plug is appropriate to adopt the central shaft for a bridge plug as provided in the present disclosure so as to increase the inner diameter of the internal fluid channel thereof as much as possible, such that a channel for communication of oil and gas can be formed before degradation or corrosion of the bridge plug members of degradable materials or corrodible materials.

Alternatively, the slip platen 6 comprises an upper slip platen 61 and a lower slip platen 62, the reducing support ring 78 comprises an upper reducing support ring 781 and a lower reducing support ring 782, and in the axial direction of the setting tubular shaft 2, the elastic sealing cylinder 9 is located between the upper reducing support ring 781 and the lower reducing support ring 782;

the upper reducing support ring 781 and the lower reducing support ring 782 are arranged between the upper slip platen 61 and the lower slip platen 62; and the upper slip platen 61 and the lower slip platen 62 are arranged between the upper slip assembly 451 and the lower slip assembly 452; and the upper slip assembly 451 and the lower slip assembly 452 are arranged between the compression ring 3 and the downstream-end support 11; under the action of an axial squeezing force exerted by the compression ring 3 and the downstream-end support 11 jointly, the upper slip assembly 451, the lower slip assembly 452, the elastic sealing cylinder 9 and the reducing support ring 78 are set and anchored on the inner wall of the sleeve where the bridge plug is located. Such a design not only leads to more balanced squeezing force on two ends of the elastic sealing cylinder 9 in the axial direction but enables more stable anchoring of the upper reducing support ring 781 and the lower reducing support ring 782.

Alternatively, in the axial direction of the setting tubular shaft 2, the downstream end 20 of the setting tubular shaft 2 extends to a position where the lower slip platen 62 or the lower reducing support ring 782 is located. In this instance, the support trunk 22 of the setting tubular shaft 2 is relatively long and is sufficient to well support and bear the elastic sealing cylinder 9, the slip platen 6, the reducing support ring 78, the compression ring 3 and the slip assembly 45.

Alternatively, at least a partial section of the outer wall of the downstream end 20 of the setting tubular shaft 2 is abutted against the inner wall of the lower slip platen 62. In this instance, when the outer cylinder of the bridge plug running tool pushes the squeezing shoulder 21 in a direction towards the bottom of the oil-gas well where the bridge plug is located, the lower slip platen 62 will not run in deflection and the setting is more desirable in reliability.

Alternatively, the upper slip assembly 451 and the lower slip assembly 452 each comprise a circumferential band 453 and at least two slips 454. In the lower slip assembly 452, the circumferential band 453 is sleeved outside the slip 454; between the slip 454 and the downstream-end support 11 is provided a limiting guide structure 14, which limits the distances, by which all the slips 454 slide in a direction towards the central axis of the setting mandrel 1, within a predetermined range. When the downstream-end support 11 and the lower slip platen 62 exert an axial pressure on the slips 454, the slips 454 can all slide to be anchored at positions on the inner wall of the sleeve where the bridge plug is located from positions close to the central axis of the setting mandrel 1 in a centered state by means of the limiting guide structure 14.

Due to the half-shaft structure of the setting tubular shaft 2, there is a gap between the end surface of the downstream end of the setting tubular shaft 2 and the downstream-end support 11. In case of the absence of the limiting guide structure 14, it is very possible that the slips 454 would slide by itself in a direction towards the central axis of the setting mandrel 1 to result in blockage of the internal fluid channel of the bridge plug. Accordingly, the limiting guide structure 14 needs to be provided so as to avoid the result that the slips 454 would slide by itself in a direction towards the central axis of the setting mandrel 1 to lead to blockage of the internal fluid channel of the bridge plug.

Alternatively, there are an even number (preferably 6-10) of slips 454, each of which comprises a tooth base 5 and an anchoring tooth element 4 embedded in the tooth base 5, wherein the slip assembly 45 is anchored on the inner wall of the sleeve where the bridge plug is located, in such a manner that the anchoring tooth element 4 is tightly abutted against the inner wall of the sleeve. When there are an even number of slips 454, the force exerted on the inner wall of the sleeve may be uniform after setting of the slips 454 on the inner wall, and the setting reliability may be more desirable.

A mounting groove is formed on the tooth base 5, the anchoring tooth element 4 is embedded in the mounting groove, and the bottom surface 41 of the anchoring tooth element 4 (the anchoring tooth element 4 is preferably a double-beveling structure) is abutted against a bottom surface of the mounting groove. The bottom surface 41 of anchoring tooth element 4 is capable of partially converting a frictional force on the anchoring tooth element 4 in an axial direction of the setting tubular shaft 2 during anchoring into a pressure in a radial direction of the setting tubular shaft 2.

In such a structure, since the bottom surface 41 of each anchoring tooth element 4 is capable of decomposing at least a part of the axial frictional force on the outer surface of the anchoring tooth element 4 by way of conversion, the lifetime of the anchoring tooth element 4 is prolonged and the working reliability thereof is improved. The volume of each anchoring tooth element 4 is far smaller than that of the tooth base 5. Preferably, each anchoring tooth element 4 is higher than the anchoring base 5 in hardness, and may be specifically made from ceramics. After other parts of the bridge plug are corroded or degraded thoroughly, the anchoring tooth element 4 may fall into the sleeve in the form of broken ceramic particles.

Alternatively, the bottom surface 41 of each anchoring tooth element 4 is a flat surface or a cambered surface, and a center line of the cambered surface or the flat surface forms an acute angle or an obtuse angle with a central axis of the setting tubular shaft 2. In such a structure, the flat surface or the cambered surface is a regular surface, which is convenient to machine, manufacture and assemble. Certainly, the technical solutions of replacing the flat surface or the cambered surface with other curved surfaces should also fall into the protection scope of the present disclosure.

Alternatively, the anchoring tooth element 4 of the upper slip assembly 451 is located at a position on the tooth base 5 close to the compression ring, and the anchoring tooth element 4 is gradually increased in thickness in a direction toward the compression ring; and/or the anchoring tooth element 4 of the lower slip assembly 452 is located at a position on the tooth base 5 close to the downstream-end support, and the anchoring tooth element 4 is gradually increased in thickness in a direction toward the downstream-end support 11. When the anchoring tooth element 4 is located at the position described above, the section of the tooth base 5 squeezing the anchoring tooth element 4 is relatively thick and higher in strength, and thus it facilitates prolonging the lifetime of the tooth base 5 and improving the working reliability thereof. When the anchoring tooth element 4 is gradually increased in thickness in the direction toward the compression ring 1 or the downstream-end support 11, it is advantageous to improve the compression resistance of the anchoring tooth element 4, prolong the lifetime and enhance the working reliability thereof.

Alternatively, the limiting guide structure 14 comprises a fan-shaped groove 141 disposed on one of the slip 454 and the downstream-end support 11, and a fan-shaped slide 143 disposed on the other of the slip 454 and the downstream-end support 11, wherein the fan-shaped slide 143 is embedded in the fan-shaped groove 141, and the respective cross sections of the fan-shaped groove 141 and the fan-shaped slide 143 vertical to the axial direction of the setting mandrel 1 are fan shaped; and when the fan-shaped slide 143 slides in the fan-shaped groove 141 in a direction towards the central axis of the setting mandrel 1 to a predetermined position, the fan-shaped slide 143 is abutted against the side wall of the fan-shaped groove 141.

The structure described above has the advantages of compact structure and high reliability. It can not only enable the slips 454 to slide towards the periphery (in a direction away from the central axis of the setting mandrel 1) to be set under axial pressure, but can also ensure the slips 454 not to slide by itself in a direction towards the central axis of the setting mandrel in natural state with the result of blocking the internal fluid channel of the bridge plug.

Alternatively, the bottom surface of the fan-shaped groove 141 is further provided with a circumferential limiting groove 142, and the fan-shaped slide 143 is further provided with a circumferential limiting protrusion 144 embedded in the circumferential limiting groove 142. The respective cross sections of the circumferential limiting protrusion 144 and the circumferential limiting groove 142 vertical to the axial direction of the setting mandrel 1 are rectangular. While the fan-shaped slide 143 slides in the fan-shaped groove 141 in a direction towards or away from the axis of the setting mandrel 1, the circumferential limiting protrusion 144 slides in the circumferential limiting groove 142 (in a direction towards or away from the central axis of the setting mandrel 1).

Such circumferential limiting can ensure the setting force exerted by the slips 454 on the sleeve in circumferential direction to be dispersed and uniform, and avoid concentration of the setting force to result in damage of the slips 454, thereby ensuring the reliability and duration of the setting effect.

Alternatively, in the circumferential direction of the lower slip assembly 452, the circumferential limiting groove 142 is located in the middle of the fan-shaped groove 141, and the circumferential limiting protrusion 144 is located in the middle of the fan-shaped slide 143. Such a structure can more effectively ensure dispersed and uniform setting force exerted by the slips 454 on the sleeve in circumferential direction, thereby ensuring the reliability and duration of the setting effect.

Alternatively, the reducing support ring 78 includes ring-shaped bodies and setting surfaces provided on the circumferential outer walls or end faces of the ring-shaped bodies. The deformations of the ring-shaped bodies under the action of the axial squeezing force allow the setting surfaces to be abutted against and set on the inner wall of a sleeve where the bridge plug is located, and to form surface contact-type sealed connection with the inner wall of the sleeve (or the well wall if necessary).

The deformations of the ring-shaped bodies in the reducing support ring 78 in the present disclosure under the action of the axial squeezing force allow the setting surfaces to be abutted against and set on the inner wall of the sleeve where the bridge plug is located, and to form surface contact-type sealed connection with the inner wall of the sleeve (or the well wall if necessary). The surface contact-type sealed connection is not only large in contact area, not prone to the occurrence of stress concentration at joints and high in structural reliability, but also more desirable and stable in sealing effect.

Alternatively, the ring-shaped bodies include a first ring-shaped body 7 and a second ring-shaped body 8 overlapping each other, wherein the setting surfaces include a first setting surface 161 provided on a circumferential outer wall or an end face of the first ring-shaped body 7 and a second setting surface 162 provided on a circumferential outer wall or an end face of the second ring-shaped body 8; and the deformations of the first ring-shaped body 7 and the second ring-shaped body 8 under the action of an axial squeezing force allow the first setting surface 161 and the second setting surface 162 to be abutted against and set on the inner wall of the sleeve where the bridge plug is located, and to form the surface contact-type sealed connection with the inner wall of the sleeve. The reducing support ring 78 with such a structure has better overall elasticity and more satisfactory setting effect.

Alternatively, before the first ring-shaped body 7 and the second ring-shaped body 8 are squeezed to be deformed, the first setting surface 161 and/or the second setting surface 162 are/is a conical surface(s) or a cambered surface(s). Such a structure not only facilitates processing, but can also easily form surface contact-type connection with the inner wall of the sleeve.

Alternatively, the respective sections of the first ring-shaped body 7 and the second ring-shaped body 8 sleeved on the elastic sealing cylinder 9 of the bridge plug, are provided with at least two gaps; or the respective sections of the first ring-shaped body 7 and the second ring-shaped body 8 sleeved on the elastic sealing cylinder 9 of the bridge plug, are provided with at least two weak areas which are split to form gaps after the deformations of the first ring-shaped body 7 and the second ring-shaped body 8, wherein each section is divided by the respective gaps into at least two forked branches provided in a circumferential direction, and the first setting surface 161 and/or the second setting surface 162 are/is located on the circumferential outer walls or end face of the forked branches;

the gaps or weak areas in the first ring-shaped body 7 and the gaps or weak areas in the second ring-shaped body 8 are staggered with each other in the circumferential direction. Such a structure more effectively increases the overall elasticity of the reducing support ring 78, and improves the setting effect.

Alternatively, each gap in the first ring-shaped body 7 is located at a middle position in the circumferential direction between two adjacent gaps in the second ring-shaped body 8. Such a structure not only can ensure the setting force to be uniform and dispersed but can improve the setting effect of the setting surfaces.

Alternatively, the reducing support ring 78 is made from a degradable material or a corrodible material. The reducing support ring 78 is naturally degraded or corroded quickly after the completion of the formation fracturing operation, so that a plug drilling process is omitted. In addition, in case of failure in setting, the reducing support ring 78 may also be degraded or corroded naturally before the setting of a new bridge plug, and therefore, the construction is convenient.

The ductility of the reducing support ring 78 may be greater than 5%. The corrosion rate of the material of the reducing support ring 78 in a solution containing 0.5% of potassium chloride at 70° C. is greater than 0.1 $mg/cm^2 \cdot hr$.

Alternatively, the reducing support ring 78 for a bridge plug further includes at least one third ring-shaped body which overlaps with the first ring-shaped body 7 and the second ring-shaped body 8, wherein a third setting surface is provided on a circumferential outer wall or an end face of the third ring-shaped body; and the deformations of the first ring-shaped body 7, the second ring-shaped body 8 and the third ring-shaped body under the action of an axial squeezing force allow the first setting surface 161, the second setting surface 162 and the third setting surface to be all abutted against and set on the inner wall of the sleeve where the bridge plug is located, and to form the surface contact-type sealed connection with the inner wall of the sleeve. Such setting means has the advantages of stable blockage effect, high anchoring reliability, and free of midway setting.

Alternatively, the elastic sealing cylinder 9, the slip platen 6, the reducing support ring 78, the compression ring 3, the upper slip assembly 451, the lower slip assembly 452 and the downstream-end support 781 are all made from degradable materials or corrodible materials. In this instance, the bridge plug of the present disclosure has good degradability after being set, so that the plug drilling process is omitted and it is convenient in construction.

Alternatively, the degradable material or corrodible material contains the following components: 2-7.8 wt % of Mg, 0.01-4 wt % of Cu, 0.01-2 wt % of Sn, 0.01-9 wt % of Zn, 0.1-4.5 wt % of Ga, 0.01-1 wt % of Mn, 0.1-4.5 wt % of In, 0.01-3 wt % of Fe and the balance of Al, with the sum of weight percentages of the components being 100 wt %.

The reducing support ring 78 prepared according to the above material component proportions may well meet the requirements of reservoir fracturing and exploration of oil and gas in degradability, corrodibility, strength and hardness. Certainly, the above disclosed material component proportions are merely preferred component proportions of the present disclosure, and a person skilled in the art can make alterations to a part or all of the elements and the weight percentages of the elements. Moreover, in addition to the reducing support ring 78 of the bridge plug, the above material may also be applied to making other parts of the bridge plug.

Alternatively, the outer wall of the downstream section of the setting tubular shaft 2 is provided with limiting serrated grooves 171, and the inner wall of the lower slip platen 62 (preferably the downstream section of the lower slip platen 62) is provided with limiting tooth elements 172. When the setting tubular shaft 2 moves to a setting position, the limiting serrated grooves 171 and the limiting tooth elements 172 are meshed with each other to lock the setting tubular shaft 2 and the lower slip platen 62 together in an axial direction. The mutual meshing of the limiting serrated grooves 171 with the limiting tooth elements 172 can prevent the setting tubular shaft 2 from slippage from the lower slip platen 62 to lead to failure in setting, thereby significantly improving the reliability of the setting operation in the present disclosure.

A method for setting any one of the above bridge plugs provided in the embodiments of the present disclosure, comprises the steps of:

a setting mandrel 1 of the bridge plug being pulled by a bridge plug running tool such that a squeezing shoulder 21 of a setting tubular shaft 2 is abutted against a compression ring 3 of the bridge plug;

the squeezing shoulder 21 being pushed by an outer cylinder of the bridge plug running tool in a direction towards the bottom of an oil-gas well where the bridge plug is located, so that the setting tubular shaft 2 slides relative to the setting mandrel 1 to a setting position;

with the setting tubular shaft 2 being in the setting position, the squeezing shoulder 21 squeezing the compression ring 3 of the bridge plug into a setting state so that the compression ring 3 and the downstream-end support 11 are abutted against the upper slip assembly 451 and the lower slip assembly 452, the upper slip assembly 451 and the lower slip assembly 452 are abutted against the slip platen 6, and the reducing support ring 78 is set onto the inner wall of a sleeve where the bridge plug is located under the action of an axial squeezing force exerted by the slip platen 6 and the elastic sealing cylinder 9 jointly;

in the case where the setting tubular shaft 2 is in the setting state, the bridge plug running tool bringing the setting mandrel 1 into movement relative to the downstream-end support so as to disconnect the setting mandrel 1 from the downstream-end support 11; and after disconnection of the setting mandrel 1 from the downstream-end support 11, the setting mandrel 1 being withdrawn from a central hole of the setting tubular shaft 2 by the bridge plug running tool so that the central hole of the setting tubular shaft 2 forms an internal fluid channel of the bridge plug.

The invention claimed is:

1. A central shaft for a bridge plug, characterized by comprising a setting mandrel and a setting tubular shaft, wherein the setting tubular shaft is provided with a central hole, and includes a squeezing shoulder for squeezing a compression ring or an upper slip assembly of the bridge plug, and a support trunk for at least supporting the upper slip assembly, a reducing support ring, a slip platen and an elastic sealing cylinder of the bridge plug;

the central hole of the setting tubular shaft is sleeved outside the setting mandrel and the setting tubular shaft is axially slidable relative to the setting mandrel to a setting position where setting tubular shaft enables the squeezing shoulder to squeeze the compression ring or the upper slip assembly of the bridge plug to a setting state;

an upstream end of the setting mandrel is adapted to be connected to a bridge plug running tool, and a downstream end of the setting mandrel is connected to a downstream-end support of the bridge plug in such a manner that in case where the setting tubular shaft is in the setting state, the setting mandrel can be disconnected from the downstream-end support by relative movement; and after disconnection of the setting mandrel from the downstream-end support, the setting mandrel can be withdrawn from the central hole of the setting tubular shaft so that the central hole of the setting tubular shaft forms an internal fluid channel of the bridge plug.

2. The central shaft according to claim 1, characterized in that, the strength of the material of the setting mandrel is 1.5 to 5 times the strength of the material of the setting tubular shaft.

3. A bridge plug, characterized by comprising an elastic sealing cylinder, a slip platen, a reducing support ring, a compression ring, an upper slip assembly, a lower slip assembly, a downstream-end support, and the central shaft according to claim 2, wherein the elastic sealing cylinder, the slip platen, the reducing support ring, the compression ring, the upper slip assembly and the lower slip assembly are all sleeved on a support trunk of a setting tubular shaft; a squeezing shoulder of the setting tubular shaft is abutted against the compression ring; and when an outer cylinder of a bridge plug running tool pushes the squeezing shoulder in a direction toward the bottom of an oil-gas well where the bridge plug is located, the setting tubular shaft slides relative to a setting mandrel to a setting position;

in case where the setting tubular shaft is in the setting state, the bridge plug running tool can bring the setting mandrel into movement relative to the downstream-end support so as to disconnect the setting mandrel from the downstream-end support;

the compression ring and the downstream-end support are abutted against the upper slip assembly and the lower slip assembly, the upper slip assembly and the lower slip assembly are abutted against the slip platen, and the reducing support ring is disposed between the slip platen and the elastic sealing cylinder; and the reducing support ring can be set onto the inner wall of a sleeve where the bridge plug is located, under the action of the axial squeezing forces exerted by the slip platen and the elastic sealing cylinder jointly.

4. The bridge plug according to claim 3, characterized in that, the slip platen comprises an upper slip platen and a lower slip platen, and the reducing support ring comprises an upper reducing support ring and a lower reducing support ring, wherein in the axial direction of the setting tubular shaft, the elastic sealing cylinder is arranged between the upper reducing support ring and the lower reducing support ring; the upper reducing support ring and the lower reducing support ring are arranged between the upper slip platen and the lower slip platen; the upper slip platen and the lower slip platen are arranged between the upper slip assembly and the lower slip assembly; the upper slip assembly and the lower slip assembly are arranged between the compression ring and the downstream-end support; and the upper slip assembly, the lower slip assembly, the elastic sealing cylinder and the reducing support ring are set and anchored on the inner wall of the sleeve where the bridge plug is located, under the action of an axial squeezing force exerted by the compression ring and the downstream-end support jointly; and the reducing support ring includes ring-shaped bodies and setting surfaces provided on the circumferential outer walls or end faces of the ring-shaped bodies; the ring-shaped bodies include a first ring-shaped body and a second ring-shaped body overlapping each other, wherein the setting surfaces include a first setting surface provided on a circumferential outer wall or an end face of the first ring-shaped body and a second setting surface provided on a circumferential outer wall or an end face of the second ring-shaped body; the deformations of the first ring-shaped body and the second ring-shaped body under the action of an axial squeezing force allow the first setting surface and the second setting surface to be abutted against and set on the inner wall of the sleeve where the bridge plug is located, and to form a surface contact-type sealed connection with the inner wall of the sleeve.

5. The bridge plug according to claim 4, characterized in that, in the axial direction of the setting tubular shaft, the downstream end of the setting tubular shaft extends to a position where the lower slip platen or the lower reducing support ring is located;

at least a partial section of the outer wall of the downstream end of the setting tubular shaft is abutted against the inner wall of the lower slip platen;

the upper slip assembly and the lower slip assembly each comprise a circumferential band and at least two slips; and in the lower slip assembly, the circumferential band is sleeved outside the slip, between the slip and the downstream-end support is provided a limiting guide structure, which limits the distances, by which all the slips slide in a direction towards the central axis of the setting mandrel, within a predetermined range, and when the downstream-end support and the lower slip platen exert an axial pressure on the slips, the slips can all slide to be anchored at positions on the inner wall of the sleeve where the bridge plug is located from positions close to an axis of the setting mandrel in a centered state by means of the limiting guide structure; and the outer wall of the downstream section of the setting tubular shaft is provided with limiting serrated grooves, the inner wall of the lower slip platen is provided with limiting tooth elements, and when the setting tubular shaft moves to the setting position, the limiting serrated grooves and the limiting tooth elements are meshed with each other to lock the setting tubular shaft and the lower slip platen together in an axial direction.

6. The bridge plug according to claim 5, characterized in that, the limiting guide structure comprises a fan-shaped groove disposed on one of the slip and the downstream-end support, and a fan-shaped slide disposed on the other of the slip and the downstream-end support, wherein the fan-shaped slide is embedded in the fan-shaped groove, and the respective cross sections of the fan-shaped groove and the fan-shaped slide vertical to the axial direction of the setting mandrel are fan shaped; when the fan-shaped slide slides in the fan-shaped groove in a direction towards the central axis of the setting mandrel to a predetermined position, the fan-shaped slide is abutted against the side wall of the fan-shaped groove; and there are an even number of slips, each of which comprises a tooth base and an anchoring tooth element embedded in the tooth base, the slip assembly being anchored on the inner wall of the sleeve where the bridge plug is located in such a manner that the anchoring tooth element is tightly abutted against the inner wall of the sleeve; a mounting groove is formed on the tooth base, the anchoring tooth element is embedded in the mounting groove, and the bottom surface of the anchoring tooth element is abutted against a bottom surface of the mounting groove; and the bottom surface of the anchoring tooth element is capable of partially converting a frictional force on the anchoring tooth element in an axial direction of the setting tubular shaft during anchoring into a pressure in a radial direction of the setting tubular shaft.

7. The bridge plug according to claim 6, characterized in that, the bottom surface of the fan-shaped groove is further provided with a circumferential limiting groove, the fan-shaped slide is further provided with a circumferential limiting protrusion embedded in the circumferential limiting groove, the respective cross sections of the circumferential limiting protrusion and the circumferential limiting groove vertical to the axial direction of the setting mandrel are rectangular; and while the fan-shaped slide slides in the fan-shaped groove in a direction towards or away from the axis of the setting mandrel, the circumferential limiting protrusion slides in the circumferential limiting groove.

8. The bridge plug according to claim 7, characterized in that, in the circumferential direction of the lower slip assembly, the circumferential limiting groove is located in the middle of the fan-shaped groove, and the circumferential limiting protrusion is located in the middle of the fan-shaped slide.

9. The bridge plug according to claim 6, characterized in that, the bottom surface of each anchoring tooth element is a flat surface or a cambered surface, and a center line of the cambered surface or the flat surface forms an acute angle or an obtuse angle with a central axis of the setting tubular shaft, the anchoring tooth element of the upper slip assembly is located at a position on the tooth base close to the compression ring, and the anchoring tooth element is gradually increased in thickness in a direction toward the compression ring; and the anchoring tooth element of the lower slip assembly is located at a position on the tooth base close to the downstream-end support, and the anchoring tooth element is gradually increased in thickness in a direction toward the downstream-end support.

10. A setting method for the bridge plug according to claim 3, characterized by comprising the steps of:

a setting mandrel of the bridge plug being pulled by a bridge plug running tool such that a squeezing shoulder of a setting tubular shaft is abutted against a compression ring of the bridge plug;

the squeezing shoulder being pushed by an outer cylinder of the bridge plug running tool in a direction towards the bottom of an oil-gas well where the bridge plug is located, so that the setting tubular shaft slides relative to the setting mandrel to a setting position; and the setting tubular shaft in the setting position enabling the squeezing shoulder to squeeze the compression ring of the bridge plug into a setting state so that the compression ring and the downstream-end support are abutted against the upper slip assembly and the lower slip assembly, the upper slip assembly and the lower slip assembly are abutted against the slip platen, and the reducing support ring is set onto the inner wall of a sleeve where the bridge plug is located under the action of an axial squeezing force exerted by the slip platen and the elastic sealing cylinder jointly;

in case where the setting tubular shaft is in the setting state, the bridge plug running tool bringing the setting mandrel into movement relative to the downstream-end support so as to disconnect the setting mandrel from the downstream-end support; and after disconnection of the setting mandrel from the downstream-end support, the setting mandrel being withdrawn from a central hole of the setting tubular shaft by the bridge plug running tool so that the central hole of the setting tubular shaft forms an internal fluid channel of the bridge plug.

11. A bridge plug, characterized by comprising an elastic sealing cylinder, a slip platen, a reducing support ring, a compression ring, an upper slip assembly, a lower slip assembly, a downstream-end support, and the central shaft according to claim 1, wherein the elastic sealing cylinder, the slip platen, the reducing support ring, the compression ring, the upper slip assembly and the lower slip assembly are all sleeved on a support trunk of a setting tubular shaft; a squeezing shoulder of the setting tubular shaft is abutted against the compression ring; and when an outer cylinder of a bridge plug running tool pushes the squeezing shoulder in a direction toward the bottom of an oil-gas well where the bridge plug is located, the setting tubular shaft slides relative to a setting mandrel to a setting position;

in case where the setting tubular shaft is in the setting state, the bridge plug running tool can bring the setting mandrel into movement relative to the downstream-end support so as to disconnect the setting mandrel from the downstream-end support;

the compression ring and the downstream-end support are abutted against the upper slip assembly and the lower slip assembly, the upper slip assembly and the lower slip assembly are abutted against the slip platen, and the reducing support ring is disposed between the slip platen and the elastic sealing cylinder; and the reducing support ring can be set onto the inner wall of a sleeve where the bridge plug is located, under the action of the axial squeezing forces exerted by the slip platen and the elastic sealing cylinder jointly.

12. The bridge plug according to claim 11, characterized in that, the slip platen comprises an upper slip platen and a lower slip platen, and the reducing support ring comprises an upper reducing support ring and a lower reducing support ring, wherein in the axial direction of the setting tubular shaft, the elastic sealing cylinder is arranged between the upper reducing support ring and the lower reducing support ring; the upper reducing support ring and the lower reducing support ring are arranged between the upper slip platen and the lower slip platen; the upper slip platen and the lower slip platen are arranged between the upper slip assembly and the lower slip assembly; the upper slip assembly and the lower slip assembly are arranged between the compression ring and the downstream-end support; and the upper slip assembly, the lower slip assembly, the elastic sealing cylinder and the reducing support ring are set and anchored on the inner wall of the sleeve where the bridge plug is located, under the action of an axial squeezing force exerted by the compression ring and the downstream-end support jointly.

13. The bridge plug according to claim 12, characterized in that, in the axial direction of the setting tubular shaft, the downstream end of the setting tubular shaft extends to a position where the lower slip platen or the lower reducing support ring is located.

14. The bridge plug according to claim 13, characterized in that, the limiting guide structure comprises a fan-shaped groove disposed on one of the slip and the downstream-end support, and a fan-shaped slide disposed on the other of the slip and the downstream-end support, wherein the fan-shaped slide is embedded in the fan-shaped groove, and the respective cross sections of the fan-shaped groove and the fan-shaped slide vertical to the axial direction of the setting mandrel are fan shaped; when the fan-shaped slide slides in the fan-shaped groove in a direction towards the central axis of the setting mandrel to a predetermined position, the fan-shaped slide is abutted against the side wall of the fan-shaped groove.

15. The bridge plug according to claim 14, characterized in that, the bottom surface of the fan-shaped groove is further provided with a circumferential limiting groove, the fan-shaped slide is further provided with a circumferential limiting protrusion embedded in the circumferential limiting groove, the respective cross sections of the circumferential limiting protrusion and the circumferential limiting groove vertical to the axial direction of the setting mandrel are rectangular; and while the fan-shaped slide slides in the fan-shaped groove in a direction towards or away from the axis of the setting mandrel, the circumferential limiting protrusion slides in the circumferential limiting groove.

16. The bridge plug according to claim 15, characterized in that, in the circumferential direction of the lower slip assembly, the circumferential limiting groove is located in the middle of the fan-shaped groove, and the circumferential limiting protrusion is located in the middle of the fan-shaped slide.

17. The bridge plug according to claim 14, characterized in that, the bottom surface of each anchoring tooth element is a flat surface or a cambered surface, and a center line of the cambered surface or the flat surface forms an acute angle or an obtuse angle with a central axis of the setting tubular shaft, the anchoring tooth element of the upper slip assembly is located at a position on the tooth base close to the compression ring, and the anchoring tooth element is gradually increased in thickness in a direction toward the compression ring; and the anchoring tooth element of the lower slip assembly is located at a position on the tooth base close to the downstream-end support, and the anchoring tooth element is gradually increased in thickness in a direction toward the downstream-end support.

18. The bridge plug according to claim 13, characterized in that, there are an even number of slips, each of which comprises a tooth base and an anchoring tooth element embedded in the tooth base, the slip assembly being anchored on the inner wall of the sleeve where the bridge plug is located in such a manner that the anchoring tooth element is tightly abutted against the inner wall of the sleeve; a mounting groove is formed on the tooth base, the anchoring tooth element is embedded in the mounting groove, and the bottom surface of the anchoring tooth element is abutted against a bottom surface of the mounting groove; and the bottom surface of the anchoring tooth element is capable of partially converting a frictional force on the anchoring tooth element in an axial direction of the setting tubular shaft during anchoring into a pressure in a radial direction of the setting tubular shaft.

19. The bridge plug according to claim 12, characterized in that, at least a partial section of the outer wall of the downstream end of the setting tubular shaft is abutted against the inner wall of the lower slip platen.

20. The bridge plug according to claim 12, characterized in that, the upper slip assembly and the lower slip assembly each comprise a circumferential band and at least two slips; and in the lower slip assembly, the circumferential band is sleeved outside the slip, between the slip and the downstream-end support is provided a limiting guide structure, which limits the distances, by which all the slips slide in a direction towards the central axis of the setting mandrel, within a predetermined range, and when the downstream-end support and the lower slip platen exert an axial pressure on the slips, the slips can all slide to be anchored at positions on the inner wall of the sleeve where the bridge plug is located from positions close to an axis of the setting mandrel in a centered state by means of the limiting guide structure.

21. The bridge plug according to claim 12, characterized in that, the outer wall of the downstream section of the setting tubular shaft is provided with limiting serrated grooves, the inner wall of the lower slip platen is provided with limiting tooth elements, and when the setting tubular shaft moves to the setting position, the limiting serrated grooves and the limiting tooth elements are meshed with each other to lock the setting tubular shaft and the lower slip platen together in an axial direction.

22. A setting method for the bridge plug according to claim 11, characterized by comprising the steps of:

a setting mandrel of the bridge plug being pulled by a bridge plug running tool such that a squeezing shoulder of a setting tubular shaft is abutted against a compression ring of the bridge plug;

the squeezing shoulder being pushed by an outer cylinder of the bridge plug running tool in a direction towards the bottom of an oil-gas well where the bridge plug is located, so that the setting tubular shaft slides relative to the setting mandrel to a setting position; and the setting tubular shaft in the setting position enabling the squeezing shoulder to squeeze the compression ring of the bridge plug into a setting state so that the compression ring and the downstream-end support are abutted against the upper slip assembly and the lower slip assembly, the upper slip assembly and the lower slip assembly are abutted against the slip platen, and the reducing support ring is set onto the inner wall of a sleeve where the bridge plug is located under the action of an axial squeezing force exerted by the slip platen and the elastic sealing cylinder jointly;

in case where the setting tubular shaft is in the setting state, the bridge plug running tool bringing the setting mandrel into movement relative to the downstream-end support so as to disconnect the setting mandrel from the downstream-end support; and after disconnection of the setting mandrel from the downstream-end support, the setting mandrel being withdrawn from a central hole of the setting tubular shaft by the bridge plug running tool so that the central hole of the setting tubular shaft forms an internal fluid channel of the bridge plug.

23. The bridge plug according to claim 11, characterized in that, the reducing support ring includes ring-shaped bodies and setting surfaces provided on the circumferential outer walls or end faces of the ring-shaped bodies; the ring-shaped bodies include a first ring-shaped body and a second ring-shaped body overlapping each other, wherein the setting surfaces include a first setting surface provided on a circumferential outer wall or an end face of the first ring-shaped body and a second setting surface provided on a circumferential outer wall or an end face of the second ring-shaped body; the deformations of the first ring-shaped body and the second ring-shaped body under the action of an axial squeezing force allow the first setting surface and the second setting surface to be abutted against and set on the inner wall of the sleeve where the bridge plug is located, and to form a surface contact-type sealed connection with the inner wall of the sleeve.

24. The central shaft according to claim 1, characterized in that, the downstream end of the setting mandrel extends beyond the central hole of the setting tubular shaft in the dropping direction of the bridge plug, and in the axial direction of the setting tubular shaft, the position where the downstream end of the setting mandrel is connected with the downstream-end support is spaced by a gap from an end face of the downstream end of the setting tubular shaft.

25. The central shaft according to claim 1, characterized in that, the axial dimension of the setting tubular shaft is ⅓~⅘ of the axial dimension of the setting mandrel.

26. The central shaft according to claim 1, characterized in that, the material of the setting mandrel is steel.

27. The central shaft according to claim 1, characterized in that, the downstream end of the setting mandrel is connected with the downstream-end support by threads or pins, and the relative movement for disconnecting the setting mandrel from the downstream-end support is a means of relative rotation or relative translation.

28. The central shaft according to claim 1, characterized in that, the upstream end of the setting mandrel extends beyond the central hole of the setting tubular shaft in a direction towards an opening of an oil-gas well where the bridge plug is located, and the upstream end of the setting mandrel is connected with the bridge plug running tool by threads.

29. The central shaft according to claim 1, characterized in that, an upstream end of the setting tubular shaft is provided at its port with an inner cone surface, of which the inner diameter is gradually reduced along the dropping direction of the bridge plug, and the upstream end of the setting mandrel is provided with an outer conical surface having a shape conforming to the shape of the inner cone surface.

30. The central shaft according to claim 1, characterized in that, the setting mandrel is provided with an axial central through-hole through the setting mandrel along the overall axial direction of the setting mandrel, and the axis of the axial central through-hole overlaps or is parallel with the axis of the central hole of the setting tubular shaft.

31. The central shaft according to claim 1, characterized in that, the setting tubular shaft is an integral structure, and the setting mandrel is formed by fixed connection of different structural members.

32. The central shaft according to claim 1, characterized in that, an outer relief conical surface is provided at an outer wall edge of the downstream end of the setting tubular shaft.

* * * * *